United States Patent [19]

Vackier et al.

[11] Patent Number: 4,492,177

[45] Date of Patent: Jan. 8, 1985

[54] APPARATUS FOR TRANSFERRING XEROGRAPHIC IMAGES

[75] Inventors: Leo N. Vackier, Gravenwezel; Jozef L. Mampaey, Kontich; Leo B. Alaerts, Boechout, all of Belgium

[73] Assignee: AGFA-Gevaert N.V., Mortsel, Belgium

[21] Appl. No.: 498,160

[22] Filed: May 25, 1983

[30] Foreign Application Priority Data

May 26, 1982 [GB] United Kingdom ..... 8215318

[51] Int. Cl.[3] ..... G03G 15/06

[52] U.S. Cl. ..... 118/651; 118/652

[58] Field of Search ..... 118/651, 652

*Primary Examiner*—Bernard D. Pianalto

*Attorney, Agent, or Firm*—William J. Daniel

[57] ABSTRACT

A xerographic liquid toner image is transferred onto an image-receiving sheet carried along an arcuate path, e.g., on the peripheral surface of a rotating drum from the underside of a flexible sheet, e.g., a photoconductor sheet, while the flexible sheet is suspended by its margins from a moving carriage. The carriage is guided generally horizontally along a path above and proximate to the top of the drum periphery at a level such that the unattached central part of the flexible sheet, which is free to sag relative to its margins, is supported by the liquid toner image itself, out of contact with the image-receiving sheet, as the two sheets pass through an image transfer zone adjacent the top of the drum periphery.

9 Claims, 9 Drawing Figures

61
60
18
78
79
43
46
5
17
74
88
75
76
73

70
71
72
17

75
77
d
76
46
80

APPARATUS FOR TRANSFERRING XEROGRAPHIC IMAGES

Various reprographic processes involve progressive image transfer to or from an arcuately curved surface rotating about its axis of curvature. Such transfer may take place from or to a flat surface in tangential relationship to such curved surface or from or to a second cylindrically curved surface rotating about its axis of curvature synchronously with the first one.

Such an image transfer procedure occurs for example in rotary offset printing machines. Another well known application of such an image transfer procedure is in xerographic document copiers in which an electrostatic image is formed on photoconductive layer on the surface of a drum and developing toner applied to the drum is transferred under the influence of an electrical field to plain paper receptor sheets.

In the known processes the progressive image transfer takes place during rolling contact between the surfaces which respectively donate and receive the image (see e.g. U.S. Pat. No. 3,071,070 and UK Patent Application 2,003,090 A, which latter specification relates both to offset duplicating and to xerographic printers).

In the field of xerographic printing, toner image transfer under rolling contact pressure between the toner image-carrying and toner image-receiving surfaces requires the observance of certain process conditions which sometimes inconveniently restrict the kinds of materials which can be used. For example the rolling contact condition is not very suitable for transferring liquid toner, either in the form of a pure liquid or a dispersion of toner particles in a liquid carrier. The need for the rolling contact also restricts the choice of materials for the co-operating surfaces of the image-donating and image-receiving elements. For example, when toner images have to be transferred to image-receiving sheets from a photoconductive element, the receptor sheets must be composed so that they do not cause damage to the photoconductive surface, which is usually not very resistant to mechanical damage. Normally, no problems arise when using plain paper receptor sheets, but it is not always suitable to use receptor sheets of that kind. A specific type of reprographic work in which toner transfer under rolling pressure contact is to be avoided if possible is the transfer of toner images from photoconductive elements to metal receptor sheets, e.g. sheets of uncoated anodised aluminium as used for the production of planographic printing plates. Such plates have a rough aluminium oxide surface which provides minute pores or recesses for toner particle retention and the surface is somewhat abrasive.

These considerations point to the need for an apparatus and process whereby a toner image can be progressively transferred to or from a rotating arcuately curved surface, from or to the image-donating or image-receiving surface as the case may be, without the necessity for pressure contact between such surfaces.

It is known that a toner image can be electrostatically transferred across a gap between the toner-carrying surface and the surface of a receptor. For achieving good transfer image quality however the gap size is critical. The gap has in general to be very small, and it must be kept substantially constant over the whole area of the image. These conditions give rise to very considerable problems in devising an apparatus and process by which moving image-donating and image-receiving elements can be reliably guided in image-transfer relationship with the precision necessary for maintaining the required surface to surface gap.

The foregoing problem of gap control is accentuated by the need, in commercial practice, to effect image transfer to or from the surfaces of sheets any one of which may, within certain tolerances, be of non-uniform thickness.

The problem is even more serious if the apparatus is required to effect transfer of toner images simultaneously to two receptor sheets of unequal or non-uniform thickness mounted side by side. To take aluminium receptor sheets as an example, the nominal thickness of such sheets may vary within a tolerance of plus or minus 15 microns so that if two such plates are mounted side by side there may be a thickness disparity of up to 30 microns between adjacent plate edges. If the two plates are of slightly different nominal thickness, such disparity may of course be even greater.

Moreover the severity of the foregoing problem tends increase as the overall dimensions of the image to be transferred increases. The problem is for example very acute if a small critical gap has to be maintained over a distance (gap length) of approximately 1 meter. This would be a requirement for apparatus to be used in preparing lithographic printing plates of large size formats, say e.g. up to 915 by 635 mm, which is the size of an opened double-page large newspaper sheet.

It is an object of the present invention to provided an apparatus and process whereby a suitable transfer gap control is conveniently achieved without the need for critical gap adjustment techniques.

Apparatus according to the invention, which is for use in transferring a liquid xerographic toner image from the surface of one element to the surface of another element includes, in common with known apparatus, a rotatable member with a cylindrically curved periphery for supporting one element in arcuately curved condition, concentric with the axis of rotation of such member, means for conveying another element, in the form of a flexible sheet, through an image transfer station traversed by the path of motion of said curved periphery of said rotatable member in superposed relation to the latter, and means at such station for forming an electrical potential gradient for effecting said image transfer. The apparatus according to the invention is characterised in that the conveying means comprises a carriage from which a flexible sheet can be suspended by marginal portions thereof, leaving the greater part of the sheet free to sag relative to such marginal portions, and in that there is means for guiding said carriage towards and past said transfer station at a level such as to allow the sagging portion of a said suspended sheet to become supported at the transfer station, out of contact with the surface of the element on the rotatable member, by liquid toner carried into said transfer station on the surface of said suspended sheet or on the surface of said curved element.

This apparatus enables toner image transfer to take place without actual contact between the toner image-donating and image-receiving surfaces. The apparatus solves the problem of maintaining an appropriate transfer gap between these surfaces by providing a carriage for carrying a flexible sheet element in the aforesaid suspended and sagging condition and by providing means from guiding said carriage in the specified relationship to the rotatable member. By virtue of these features, when the apparatus is put to use, a sheet element of appropriate flexibility having been attached to its carriage and liquid toner being image-wise distributed over the bottom surface of such sheet or over the exposed outer surface of the element carried by the rotatable member, portions of the suspended sheet arriving successively at the transfer station will be supported at that station, out of contact with the element itself, by the liquid toner present. This means in effect that the intersurface gap at the critical image transfer zone, is determined and maintained from moment to moment by the liquid image then present at that zone. It follows also that any non-uniformity in the thickness of either of the elements providing the image-donating and image-receiving surfaces is substantially eliminated.

Electrostatic latent images developable by application of liquid toner can be conferred on non-photoconductive insulating elements and such an element can be used as the toner image-donating element when performing an image transfer process in apparatus according to the present invention. However it is in general much more satisfactory to form the initial electrostatic image directly on a photoconductive element and such an element is preferrably employed as the toner image-donating element.

The rotatable member for supporting a toner image-donating or image-receiving element on its cylindrically curved periphery may carry such element as an integral part thereof, such element being capable of repetitive use as an electrostatic latent image carrier, the successive images being "erased" after toner development and image-wise transfer of toner to a flexible element suspended on its carriage. Such an integral element can for example be a photoconductive layer formed on the said cylindrically curved periphery of the rotatable member.

In preferred embodiments of the invention the rotatable member has means for releasably and temporally holding a flexible sheet element taut against its cylindrically curved periphery. When such apparatus is used, the rotatable member can hold a flexible image-donating sheet element, i.e. a sheet carrying a liquid toner-developed electrostatic charge image. Alternatively, and preferably, the present apparatus will be arranged for effecting toner image transfer from an image-donating sheet element suspended from the carriage, to an image-receiving sheet releasably mounted on the rotatable member. As compared with apparatus in which charge images have to be formed on a recording layer carried by the rotatable member, apparatus in which the rotatable member is a sheet holder having means for releasably holding a flexible sheet element against its periphery affords the important advantage that the electrostatic charge images can be formed and developed at any convenient station or stations separate from the rotatable member and while the flexible sheets are in flat, stationary condition. This advantage is particularly important when forming a charge image on a photoconductive sheet because the optical system for projecting a light image onto a sheet can be simpler than an optical system for projecting light images onto a rotating drum or the like.

The invention includes apparatus in which the rotatable member has means for releasably and temporarily holding a flexible sheet element as above referred to.

The cylindrically curved periphery of the rotatable member may subtend 360°, but this is not essential. Such surface can subtend a smaller angle. It length, measured along the line of its curvature, determines the maximum flexible sheet dimension, measured along that line, which the rotatable member can effectively support. A very advantageous form of rotatable sheet support is one comprising segmental components having peripheral portions of intermeshing comb-like structure which together form the cylindrically curved element supporting surface, such components being relatively angularly displaceable for varying the dimension of such surface as measured along the line of its curvature. Such a sheet support, having means for holding a flexible sheet taut against the cylindrically curved surface, is described in co-pending European Patent Application No. 83 200 310.7 filed on Mar. 4, 1983.

Apparatus according to the invention and having its rotatable member in the form of a holder for releasably holding flexible sheet elements is very well suited for use in the production of planographic printing plates by a process involving transfer of toner images to plate blanks temporarily mounted on such holder, e.g. blanks formed by uncoated anodized aluminium plates as hereinbefore mentioned. However the apparatus can equally well be used for the production of high-grade reproductions on plain-paper, plastic or other suitable supports.

In some apparatus according to the invention the carriage for the flexible sheet element has a bottom wall to which marginal portions of a flexible sheet can be attached and which (in plan aspect) covers the entire area within which the flexible sheet will lie when suspended. For attaching marginal portions of a flexible sheet to such surface, use can be made of adhesive strips, e.g. strips of self-adhesive tape. Suitable adhesive tape can be laid between the margins of the flexible sheet and the planar bottom face so that the tape forms a shallow rim depending from such face. As an alternative the carriage can have integral depending rim portions which extend along the margins of the sheet suspension area. Margins of a sheet can be secured to the carriage in direct contact with such rim portions.

Preferably the carriage has bottom face portions to which all four marginal portions of a rectangular flexible sheet can be attached for holding the sheet suspended. However, it is in some cases possible to achieve useful results by suspending a sheet by only one pair of opposed marginal portions and there is scope for designing the carriage accordingly.

Advantageously, the carriage comprises a chassis portion which is guided by the carriage guide means, and a sheet carrying portion from which a sheet can be suspended as described above and which can be raised from its sheet suspending position on said chassis into a position which is more convenient for exposing an attached photoconductive sheet to a light image. After image-wise exposure of a photoconductive sheet in that position, the sheet-carrying frame, with the image-wise exposed sheet attached thereto, has simply to be brought into its sheet suspending position on the chassis. Preferably the sheet-carrying frame is pivotally connected to the chassis so that said sheet-carrying frame can be swung upwardly through at least 90° from its sheet suspending position.

Preferably the carriage has a rigid sheet-backing surface which lies behind the main central part of a flexible sheet when it is attached to the carriage and the carriage is associated with means for aspirating air from between such sheet and the backing surface and thereby drawing the central part of the sheet flat against such surface. That feature is of value for holding a photoconductive sheet in flat condition during image-wise exposure of the sheet and also during overall electrostatic charging thereof. By exerting the air pressure between the sheet and backing surface slight adjustment of the flexural resistance of the sheet during the toner transfer step can be effected.

The invention includes a xerographic printing machine which incorporates toner image transfer apparatus as hereinbefore defined and which also incorporates means for confering an electrostatic charge pattern on a flexible photoconductor sheet while it is supported in flat condition, and means for applying liquid toner to develop such charge pattern preparatory to conveyance of the flexible sheet through the toner transfer station by the sheet carriage.

The invention includes a process of forming and transferring a xerographic toner image from a first surface to a second surface, one such surface being an arcuately curved surface rotating about its axis of curvature and the other surface being the surface of a flexible sheet which is moved, synchronously with said curved surface, along a substantially straight horizontal path through a transfer zone traversed by the path of both of the arcuately curved surface and the flexible sheet, while an electrical potential gradient is maintained to cause said toner transfer to take place at that zone, characterised in that the toner image to be transferred is formed by developing an electrostatic charge image by means of liquid toner, and in that the flexible sheet is conveyed through the transfer zone by means which suspends the sheet by marginal portions thereof so that a main central part of the sheet can sag relative to such margins and be supported at the transfer zone, out of contact with the cylindrically curved surface, by the liquid toner present at the zone.

Preferably the cylindrically curved surface is the surface of a flexible sheet held by a rotating sheet supporting member and said other surface is the surface of a flexible photoconductive sheet on which the toner image to be transferred is formed.

When using apparatus according to the invention it is desirable to avoid too much flexure of the main central part of the suspended flexible sheet. Depending on the size of such sheet, it is sometimes an advantage for a central part of that sheet to have a greater resistance to flexure than an outer zone or zones of the sheet. Accordingly in some embodiments of the invention, the suspended flexible sheet exhibits, in its sagging area, a main central zone having greater resistance to flexure than an outer zone or zones located between such central zone and the marginal portions by which such sheet is suspended. A relatively high resistance to flexure may be conferred on a central zone by providing the sheet with an attached stiffening element or layer confined to that zone. Such a stiffening element or layer can e.g. be secured to the rear of the flexible sheet or incorporated between such sheet and one or more coatings.

The invention also includes embodiments wherein the suspended flexible sheet exhibits a greater resistance to flexure along lines normal its direction of movement through the transfer zone i.e., end to end flexing, than along lines parallel thereto i.e., side to side flexing. It is excess flexibility along lines normal with the direction of movement which is more liable to impair the transfer image quality.

When using a photoconductive sheet as the suspended sheet, it is suitable, for example, to use a sheet comprising a polymeric substrate e.g. a substrate of polyethylene terephthalate, having a thickness in the range 100 to 200 microns. Such substrate can carry an electrically conductive layer and a photoconductive layer. The electrically conductive layer can be on the rear side of the substrate or between the substrate and the photoconductive layer. Such an electrically conductive layer can be confined to a main central area of the street and serve as a stiffening layer as above referred to.

Certain embodiments of the invention will now be described by way of example with reference to the accompanying drawings, wherein:

DETAILED DESCRIPTION OF THE DRAWINGS

Figure 1:
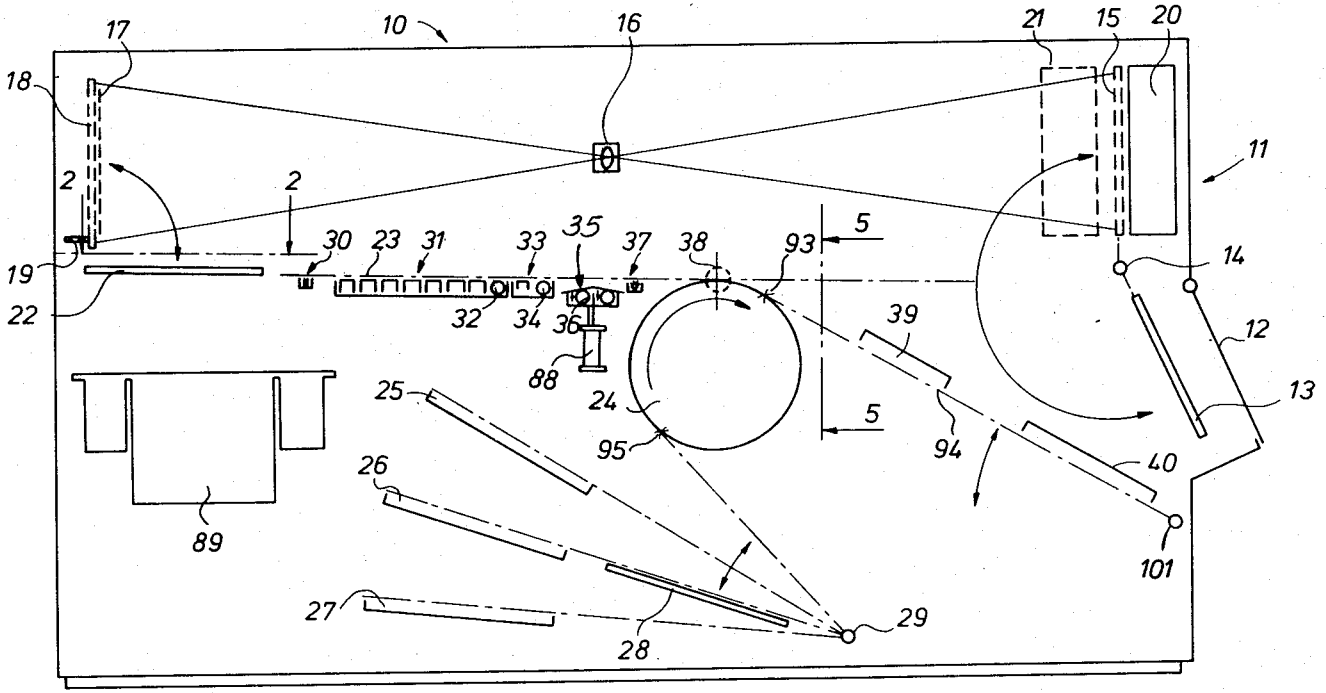
FIG. 1 is a diagrammatic longitudinal sectional view through one embodiment of an apparatus according to the invention.

Referring to FIG. 1 which shows a diagrammatic illustration of a lithographic platemaking unit, the apparatus is mounted within an elongated light-tight housing 10 that is provided at its frontside 11 with a rectangular, light-tightly closable panel 12 that permits an operator to fit a paste-up to be reproduced onto a pivotable transparent holder 13. The holder 13 is preferably fitted with a vacuum system, so that by atmospheric pressure the paste-up may be urged into intimate contact with the flat supporting board of the holder. The holder may be swung about a horizontal pivot axis 14 into a vertical position 15 illustrated in broken lines. In that position the location of the paste-up is at the left-hand side of the holder according to the drawing, and the image of the paste-up may be projected by a lens 16 onto a reusable photoconductor sheet 17 that is fitted to a sheet holder 18. The sheet 17 and the holder 18 have been illustrated in broken lines in a vertical exposure position since they are pivotable about a pivot axis 19 into an almost horizontal operative position wherein the processing and the transfer of the toner image occur. The lighting of a paste-up may occur by means of lamp boxes such as 20 and 21. The lamp box 21 is arranged for pivotation out of the path of holder 13, in order to enable the movements of the holder between its upper and lower position.

The photoconductor holder 18 forms part of a carriage 22 which is movable along a generally horizontal path indicated by the dash and dot line 23 which is substantially tangential to a cylindrically curved sheet supporting member 24 onto which a receptor sheet in the form of an uncoated anodized aluminium plate may be fitted.

Aluminium plates of different formats are stored in bins such as 25, 26 and 27, and a plate transfer mechanism 28 that is pivotable at 29, is arranged to transport the desired plate to the member 24. In the case of smaller plate formats, the plates may be loaded in a bin as pairs of plates, and they may be fed to the drum in side by side relationship. A suitable device for gripping and lifting the plates by the mechanism 28 is disclosed in co-pending Patent Application filed on even date herewith an entitled: "An object holding device of sucker-cup type and sheet dispensing apparatus incorporating such device".

The member 24, called hereinafter "drum" for the sake of simplicity is provided with means for receiving a plate or plates and for clamping the same in a predetermined position on the periphery of the drum. A suitable construction for the drum that is capable of receiving different sheet formats and of holding them taut against the drum surface is disclosed in our co-pending European Patent application No. 83 200 310.7, filed on Mar. 4, 1983.

The following processing stations are provided for the photoconductor sheet 17:

A corona discharge station 30 for the uniform charging of the photoconductor during its return movement, following one transfer operation and prior to the image-wise exposure.

A liquid toner developing station 31 wherein the electrostatic charge pattern that remains after the image-wise exposure, is developed by liquid toner comprising toner particles in a carrier liquid, and wherein a reversely rotating roller 32 controls the thickness of the layer of remaining developing liquid. A suitable developing device for this purpose is disclosed in European Patent application No. 83 200 070.7 filed Jan. 19, 1983.

A rinsing station 33 wherein the photoconductor surface is rinsed with a toner-free liquid, such as isododecane, thereby to clear the background of the image, and wherein a reversely rotating roller 34 controls the thickness of the remaining rinsing liquid layer.

A cleaning station 35 with rotatable resilient cleaning rollers 36 and scraper blades for cleaning the photoconductor during its return movement. The station may be vertically projected and retracted over some centimeters, by means of a mechanism represented diagrammatically by the cylinder 88, thereby to be operative only during the return movement of the carriage.

A reconditioning station 37 wherein the photoconductor is flooded with light during its return movement to prepare it for the next imaging cycle.

A toner transfer station, indicated by a circle 38 in broken lines, wherein there is means (not shown) for maintaining a suitable potential difference between the photoconductor and the aluminium plate on the drum 24 for causing progressive image-wise transfer of toner onto the aluminium plate during the movement of the photoconductor past the rotating receptor plate.

A drying station 39 and a fixing station 40 for treating the aluminium plate after it has been removed from the drum 24, and transferred to the outlet of the apparatus. The fixing station 40 may be arranged for pivotation about an axis 101, so that it may be swung into a horizontal position for discharging the printing plate(s) from the apparatus.

It will be understood that the apparatus comprises many other facilities and features such as electrical and electronic control means, liquid supply means as diagrammatically illustrated by the numeral 86, pumps, filters, safety devices, etc. All these measures belong to the state of the art and they require no further description.

Figure 2:
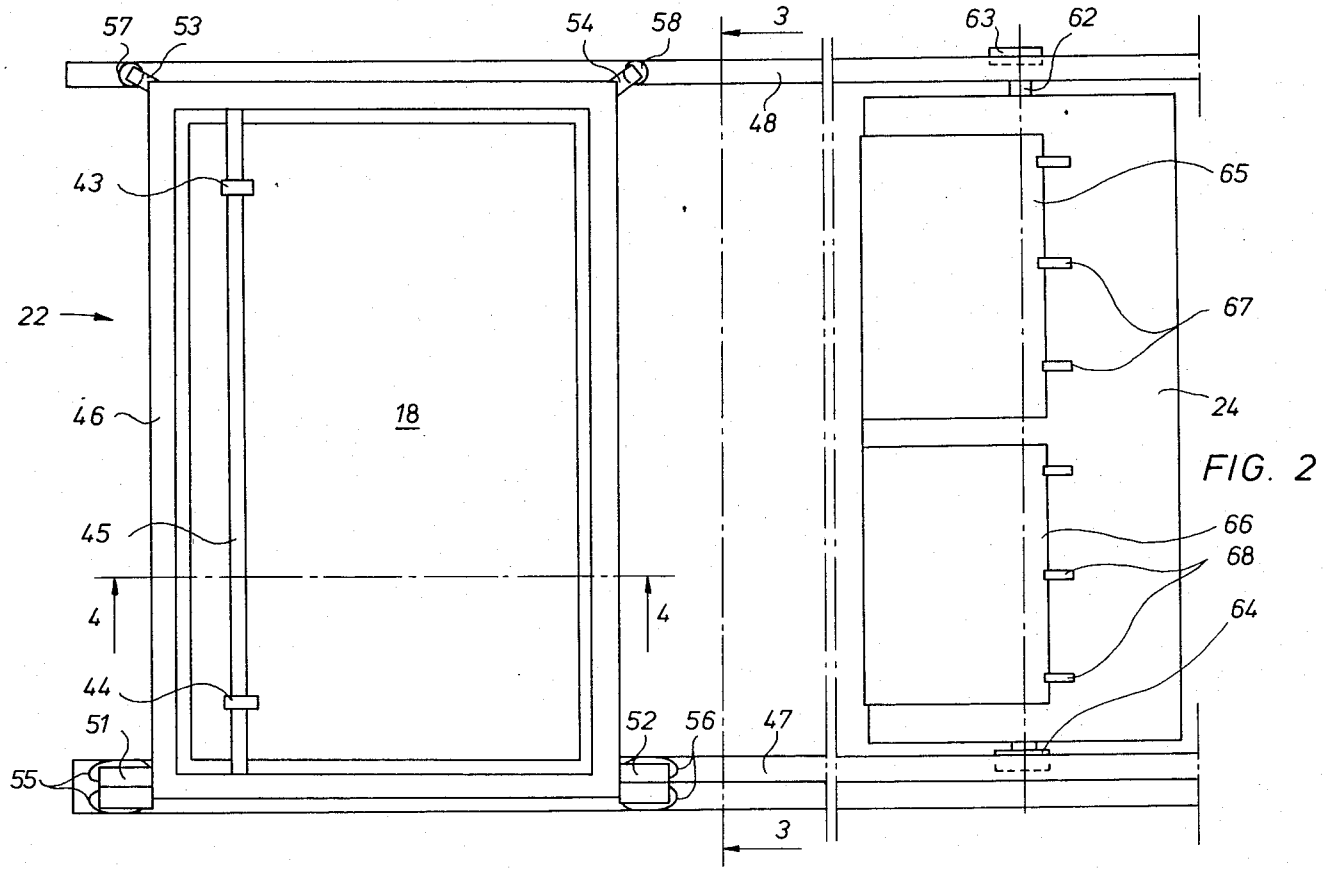
FIG. 2 is a plan view on an enlarged scale, on line 2—2 of FIG. 1 of the rotatable member and of the linearly movable carriage.
Figure 3:
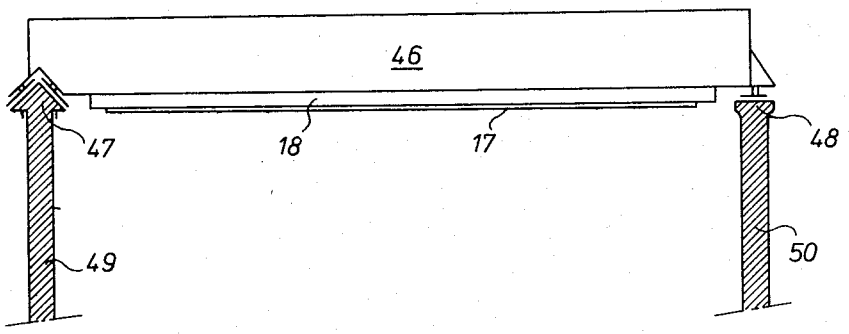
FIG. 3 is a tranverse sectional view of the apparatus on line 3—3 of FIG. 2.

Referring to FIG. 2, the holder 18 is provided at its upper side with two bearing blocks 43 and 44 whereby the holder is pivotally journalled on a shaft 45 that is fitted in a rectangular rigid frame 46. The frame 46 constitutes the chassis part of the carriage 22. This carriage is guided by rails 47 and 48 that are provided on top of vertical walls 49 and 50 (see FIG. 3). The frame is provided at its four corners with brackets 51 through 54 carrying twin air-bearing heads such as 55 and 56 and single air-bearing heads such as 57 and 58. The use of air bearings for supporting a travelling carriage in a friction free manner is known per se. The bearing heads are self-adjustable and readily align themselves with the bearing surfaces of the rails. The rail 47 is V-shaped form, to ensure the lateral guidance as well as the vertical support of the carriage. The rail 48 has a horizontal supporting surface which only provides for the vertical support of the carriage via the associated air bearings. The air-bearings are connected via flexible hoses, not shown, to an air-pressure supply. The holder 18 is provided with means, not illustrated, for swinging the holder into the vertical position shown in FIG. 1, and with a projection 60 for cooperation with an abutment 61, see FIG. 4, for ensuring that the holder is exactly parallel with the rails 47 and 48 when the holder is on its lowered position.

The drum 24 is rotatably journalled via its shaft 62 in bearings such as 63 and 64 (see FIG. 2). Two aluminium printing plates 65 and 66 are held mounted side by side on the drum by grippers such as 67 and 68, illustrated for one end of the plates only.

The driving of the carriage 22 and of the drum 24 may occur by any means known in the art, capable for ensuring that both members move at a constant, unfluctuating speed, and that, at least at the transfer zone 38, the speeds of the two members are equal. A suitable device for controlling the speed of the carriage through the toner transfer zone is disclosed in our co-pending Patent application filed on even day herewith and entitled: "Apparatus for transferring xerographic images".

Figure 4:
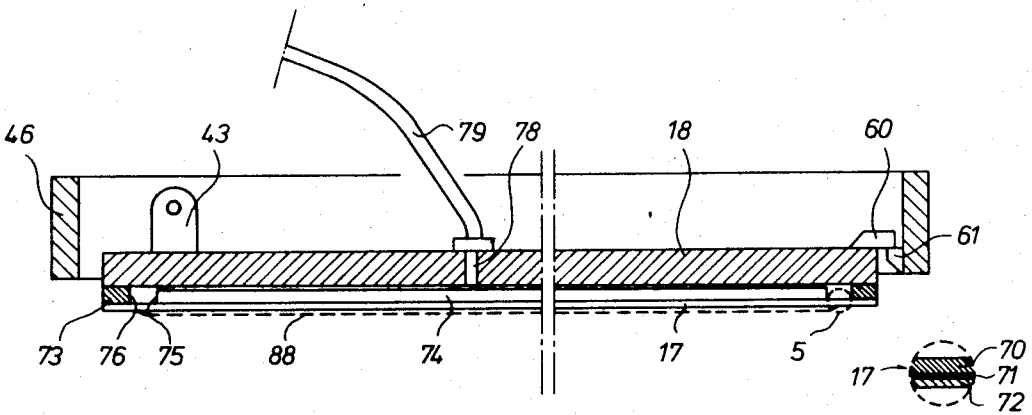
FIG. 4 is a longitudinal sectional view of the carriage of the apparatus on line 4—4 of FIG. 2.
Figure 5:
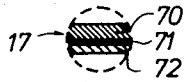
FIG. 5 is a fragmentary view illustrating the composition of the photoconductor.

The photoconductor sheet 17 is a flexible sheet, that in the present example is composed of a polymeric substrate 70 on which an electrically conductive layer 71 and a photoconductive layer 72 have carried (see FIG. 5 which is an enlarged view of the encircled detail 5 of FIG. 4).

The four margins of photoconductor sheet 17 are attached to the holder 18 by strips of self-adhesive tape which form a shallow rim 73 depending from the bottom surface of the holder.

Figure 6:
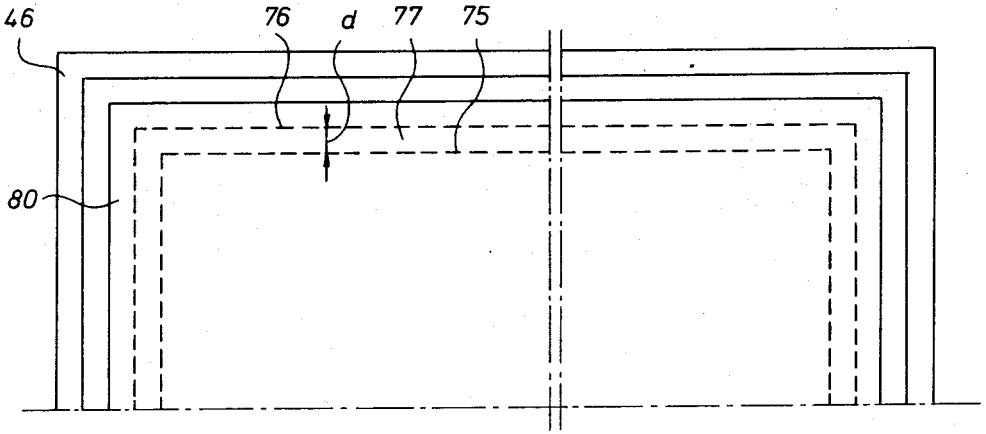
FIG. 6 is a bottom view of part of the linear carriage.

The rear side of the substrate 70 of the photoconductor sheet 17 has an attached backing layer in the form of a rectangular flexible metal plate 74. This plate is secured over its entire area to the substrate 10 e.g. by glueing. The plate 74 is somewhat smaller than the area enclosed by rim 73 so that a continuous zone 77 with a width d is left around the perimeter of sheet 17 between the peripheral edge 75 of the plate 74 and the inner edge 76 of such rim (see FIG. 6).

The plate 74 increases the resistance to flexure of the photoconductor sheet over the area of the plate while however leaving that area sufficiently flexible for present purposes as hereafter explained. The photoconductor sheet retains its initial low GV 1202 resistance to flexure in the perimeter zone 77. The thickness of the plate 74 corresponds approximately with the thickness of the rim 73, so that the photoconductor sheet 17 is flat when the backing plate 74 is in contact with the bottom surface of the holder 18. For the sake of clarity, in FIG. 4 a small spacing is shown between 14 and 18, but there is in fact no such spacing when the photoconductor sheet 17 is in unflexed condition.

The holder 18 is provided with a suction opening 78 that is located approximately in its center, and is connected to aspirating means such as a vacuum pump. The aspirating means may be mounted on the carriage 22, or it may be provided at another place in the apparatus and connected to the holder 18 via a suitably guided flexible conduit such as 79.

Starting with the operation of the disclosed apparatus is as follows. The carriage 22 in a rest position that may be situated approximately over the cleaning station 35, the driving means for the carriage is activated to drive the carriage in the left-hand direction, according to FIG. 1, until the carriage has reached the position illustrated in FIG. 1. Corona discharge station 30 uniformly sprays the photoconductor sheet 17 with negative charges during the passage of the sheet through that station. When the carriage has reached its end position, the holder 18 is swung into the position indicated in broken lines and air is aspirated from between the photoconductor sheet 17 and the holder 18 so that the backing plate 74 of the sheet is held in firm contact with the bottom surface of the holder 18. Next, the photoconductor is image-wise exposed whereby surface charges at the light image regions are removed. After the exposure, the holder is lowered into its horizontal position, and the driving means is reversed to drive the carriage through the successive processing stations. In the developing station 31, the electrostatic charge pattern of the photoconductor is developed by contact with the liquid toner at the top of the developing station. The thickness of the liquid toner layer deposited on the photoconductor according to the charge pattern is reduced to some tens of micrometers by the reversely rotating thickness control roller 32. The developed charge image is then rinsed in the rinsing station 33. The deposits of liquid toner on the photoconductor sheet when it reaches the transfer zone 38 have a thickness of some tens of micrometers. The guidance of the carriage 22 at the transfer station is such that the free surface 80 (see FIG. 6) of the marginal portion of the photoconductor sheet 17 that adheres to the rim 73 is at a level which is a few tenths of a millimeter from the receiving surface of the aluminium plates. The vacuum pressure on the rear side of the photoconductor sheet is removed before the sheet reaches the transfer station, so allowing the part of the photoconductor sheet which is unattached to the rim 13 to sag. In consequence this part of the sheet becomes supported by the quanta of toner liquid as the latter is transferred to the aluminium plates at the transfer zone. The position of the free surface of the sagging part of the sheet 17 following interruption of the vacuum is indicated by the broken line 88 in FIG. 4. A suitable D.C. potential difference between the photoconductor sheet 17 or, more specifically, its conductive layer 71 and the drum 24 with the aluminium plates, causes the progressive transfer of the toner image to the plates. The presence of the more highly flexible zone 77 of the photoconductor sheet 17 enables the sheet to adjust itself to any small variations in the level of the exposed surfaces of the aluminium receptor plates caused by variations in their thickness. The level at which successive portions of the photoconductor sheet are supported at the transfer zone is determined by supporting forces of the liquid and gravity forces acting on the mass of the photoconductor sheet 17 including its backing plate 74. In a practical example, the separation between the opposite surfaces of the photoconductor sheet and of the receptor sheets at the transfer zone is not greater than 10 microns.

Figure 7:
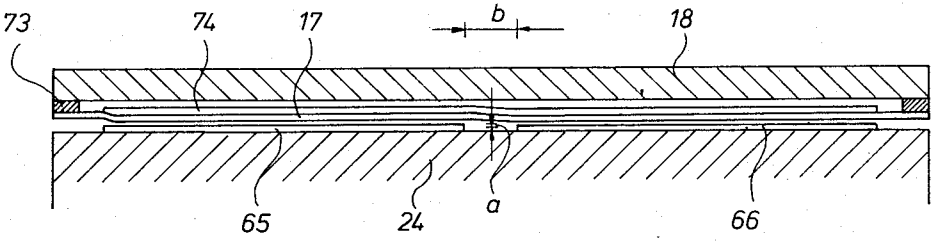
FIG. 7 is an enlarged cross-sectional view showing diagrammatically the conformation of the photoconductor sheet to two receptor plates on the cylindrical member.

If the aluminium plates show thickness variations from one lateral edge to the other, the photoconductor sheet conforms itself to the profile of the plates. This is illustrated in an exaggerated way in FIG. 7, wherein the two aluminium plates 65 and 66 have a wedge-like cross-section. The difference in thickness may, e.g. amount to 15 microns from one edge to the other for a nominal plate thickness of 125 microns. The resulting relative thickness difference a between the adjacent plate edges amounts therefore to 30 microns, the spacing b between the plates being 15 mm. It has been found that even for plate thickness deviations of this order of magnitude, the described suspended condition of the photoconductor sheet ensures a satisfactory toner image transfer, without any reduction of the image quality, considered from one lateral edge of a plate towards the other edge. The backing plate 74 ensures a sufficient biasing of the photoconductor sheet 17 without, however, reducing too much the flexibility of the sheet.

After the drum 24 has performed a revolution of approximately 390 angular degrees from its starting position, the grippers 61 holding the leading edge of the aluminium plates to the drum are released, so that from the position indicated at 93 (see FIG. 1) the plates leave the drum and are transported by means not illustrated, along a path 94 past the drying station 39 where the developer liquid is evaporated, and a fixing station 40 where the toner image is fused into the printing surface of the aluminium plates. The plates are then ready for removal from the apparatus and for an optional treatment with a liquid lithographic preparation containing a compound enhancing the ink and/or lacquer receptivity of the transferred toner image, and containing further a compound increasing the ink-repelling characteristics of the plate metal. After the plates have left the drum 24, the drum continues to rotate until at a plate loading position, indicated at 95, the leading edge of a new plate or new plates as the case may be, is or are fed by the mechanism 28 to the drum. During further rotation of the drum to accept a new plate, the carriage with the photoconductor is returned to its position towards the left-hand side of FIG. 1. During the return movement, the light source 37 is energized to uniformly expose the photoconductor, and the cleaning station 35 is brought to operative position by raising the cylinder 88 so that the station makes contact with the photoconductor during the latter's return motion and flushes away some residual toner particles.

The following data relate to a specific example of the apparatus as described and illustrated:

| | |
|---|---|
| size of photoconductor: | 925 × 635 mm |
| photoconductor sheet 17: | layer 70 is a polymer support with a thickness of 110 microns<br>layer 71 is an electrically conductive layer<br>layer 72 is the photoconductive |

-continued

| | |
|---|---|
| | layer |
| backing plate 74: | an aluminium plate measuring 905 × 615 mm, thickness 125 microns |
| inner size of frame 73: | 915 × 625 mm |
| thickness of frame 73: | 125 microns |
| width d of peripheral zone 77: 5 mm | |
| aluminium receptor plate 65 and 66: 280 × 460 mm | |
| plate formats useable in the apparatus: | 280 × 460 mm |
| | 396 × 576 mm |
| | 627 × 915 mm |

The invention is not limited to the described embodiment.

Figure 8:
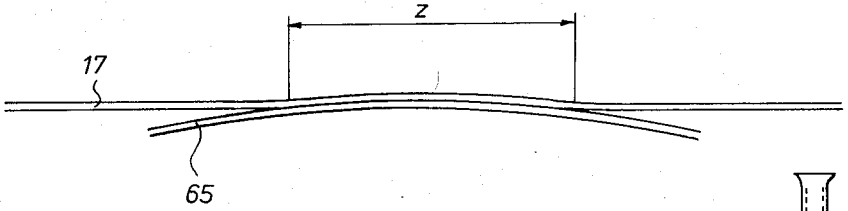
FIG. 8 is an enlarged side view showing the curvature of the photoconductor sheet about the receptor plate.

The flexible photoconductor sheet may have a lower resistance to flexure along transverse lines than along longitudinal lines. The advantage of this feature is described hereinafter with reference to FIG. 8 wherein the photoconductor sheet 17 is shown following over the zone z a path that deviates from a truly straight direction. The separation between the photoconductor and the receptor sheet has not been shown in this figure.

Figure 9:
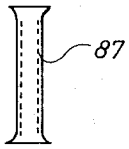
FIG. 9 illustrates a typical toner transfer fault.

The sheet 17 can assume the illustrated curvature over the zone z because of the ready flexibility of the sheet 17 along transverse lines to the direction of its movement through the transfer station. It has been found that an insufficient resistance to flexure along such transverse lines can be a cause of unsatisfactory toner transfer quality. A typical consequence of a fault caused by a relatively long zone z is a solid toner image area wherein there is a plurality of high density black spots in alignment with the edges of the area. Referring to FIG. 9, by way of example the letter I has been illustrated as showing the described characteristic defect in the form of spots 87. The area of the letter should actually be uniformly black. The presence of the unwanted dots of relatively high density reduces the actual density of the other (major) part of the image.

The described difficulty may be avoided by causing the flexible photoconductor sheet to follow a path having a shorter line of curvature about the receptor sheet. A good and simple technique for attaining the desired effect is the use of a photoconductor sheet with a differential flexibility, namely a flexural resistance which is higher about longitudinal lines than about transverse lines direction. One way of making such a sheet is to adhere the photoconductor sheet to a backing sheet or web composed of different layers of oriented fibers embedded in a suitable polymer, the number of fibers that are oriented in a direction parallel with the direction of movement of the sheet being appreciably larger than the number of fibers that are transversely oriented so that the sheet has relatively greater longitudinal stiffness. Suitable fibers for such backing sheet or plate are carbon fibers.

The mounting of the photoconductor sheet may occur otherwise than by means of the adhesive tape between the sheet and the holder. For example, the holder 18, which is made of metal such as cast aluminum or iron, may be formed with an integral peripheral rim so that a sheet can be secured in direct contact with such rim.

The flattening of the photoconductor sheet against the support 18 preparatory to the image-wise exposure may be achieved in other ways, for instance by incorporating electromagnets in the holder 18 and by the provision of a magnetizable backing plate on the photoconductor sheet, so that energizing of the magnets causes the backing plate to be drawn against the flat surface of the holder 18.

The photoconductor sheet may comprise a substrate of polymeric material e.g. polypropylene or a polyester. Alternatively, it may comprise a metal substrate, e.g. aluminium or steel.

The mounting of the flexible photoconductor sheet may be achieved otherwise than by attaching a margin of the sheet to a support which follows a fixed horizontal path through the transfer station. For instance, the photoconductor sheet may be fixed at its rearside, along its margin, to a bellowslike support permitting bodily vertical displacement of the sheet over a limited distance.

The exposure of the photoconductor sheet need not necessarily be an unitary exposure as in the above specific embodiment. The exposure may be a scanning exposure, for instance a linewise exposure of the photoconductor sheet, as it starts to travel along the path 23, by means of a laser beam or an exposure head comprising one or more lines of light-emitting diodes (LED's) mounted just upstream the developing station 31. In this way signals representing reading (textual) or pictoral images can may be electronically generated, permitting gradation control, image reversal, etc.

We claim:

1. Apparatus for transferring a liquid toner image from one element surface to another element surface comprising a first carriage movable through an arcuate path around a fixed axis, a second carriage movable through a generally horizontal path extending above and in close proximity to the top of the arcuately curved path of said first carriage, means for advancing said two carriages substantially synchronously through said paths to bring said carriages to the locus of proximity substantially simultaneously, means on the uppermost of said carriages for suspending a flexible sheetlike element by the margins thereof with the unsupported remainder of the flexible element free to sag therebelow, means on the lowermost of said carriages for rigidly supporting a second element, means for forming a liquid toner image on a surface of one of said elements which faces the other said element when the same are carried through said paths by said carriages, which toner image directly contacts the surface of the other elements as said elements pass through the locus of proximity of their paths and supports the surface of the flexible element out of contact with said other element surface, and means disposed adjacent the locus of proximity of said carriage paths for forming an electrical potential gradient across said two elements for effecting during their passage through said locus transfer of said liquid toner image from the surface on which it is formed to the other element surface.

2. The apparatus of claim 1 wherein said second carriage is a cylindrical member mounted for rotation about its axis, at least a portion of its periphery being rigid with said second element supported thereon, and the path of said horizontally advancing first carriage extends above said cylindrical member.

3. Apparatus according to claim 1, wherein the carriage for said flexible sheetlike element has a rigid bottom wall to which the marginal portions of said flexible element can be attached and which is at least as large in area as said flexible element.

4. Apparatus according to claim 3, wherein said bottom wall has a peripheral rim depending therefrom for holding marginal portions of said flexible element.

5. Apparatus according to claim 4, wherein said rim is formed by adhesive strips for self-adhesion to the margins of said flexible element.

6. Apparatus according to claim 1, wherein said second horizontally advancing carriage comprises a chassis member which is driven by said carriage advancing means, and an element-supporting frame member can be moved independently from its horizontal element-suspending position to a different position suitable when the element carried by said second carriage is a photoconductor sheet for exposing the same while in said frame member to a projected light image.

7. Apparatus according to claim 6, wherein said element-suspending frame member is pivotally connected to said chassis member so that said element-suspending frame member can be swung upwardly through at least 90° from its horizontal element-suspending position.

8. Apparatus according to claim 1, wherein the uppermost carriage has a flat backing surface which lies behind the main central part of the flexible element when it is suspended from the carriage, and the carriage is associated with means for aspirating air from between such element and said backing surface and thereby temporarily drawing said central part of such element flat against such surface.

9. Apparatus according to claim 1, wherein said flexible element is a photoconductor sheet and said apparatus includes means for creating an image pattern of electrostatic charges on said flexible photoconductor sheet while on said carriage, and means for applying liquid toner to develop said charge pattern preparatory to advancing said carriage along its path.

* * * * *